US007754314B2

(12) United States Patent
Rosset et al.

(10) Patent No.: US 7,754,314 B2
(45) Date of Patent: Jul. 13, 2010

(54) SECURITY PAPER HIGHLY RESISTANT TO DOUBLE FOLDING AND METHOD FOR MAKING SAME

(75) Inventors: Henri Rosset, Le Pin (FR); Pierre Doublet, Saint-Brice (FR)

(73) Assignee: Arjowiggins Security, Issy les Moulineaux (FR)

( * ) Notice: Subject to any disclaimer, the term of this patent is extended or adjusted under 35 U.S.C. 154(b) by 950 days.

(21) Appl. No.: 10/584,763

(22) PCT Filed: Dec. 29, 2004

(86) PCT No.: PCT/FR2004/003403

§ 371 (c)(1),
(2), (4) Date: Jun. 28, 2006

(87) PCT Pub. No.: WO2005/073464

PCT Pub. Date: Aug. 11, 2005

(65) Prior Publication Data

US 2007/0164556 A1 Jul. 19, 2007

(30) Foreign Application Priority Data

Dec. 30, 2003 (FR) ..... 03 15575

(51) Int. Cl.
*B32B 7/14* (2006.01)
*D21F 13/00* (2006.01)
*D21F 11/00* (2006.01)

(52) U.S. Cl. ..... 428/201; 428/195.1; 283/113; 162/132; 162/140

(58) Field of Classification Search ..... 428/195.1, 428/201, 204, 206, 211.1, 537.5, 916; 283/57, 283/58, 59, 72, 83, 85, 92, 113; 162/123, 162/132, 140
See application file for complete search history.

(56) References Cited

U.S. PATENT DOCUMENTS

| | | | | |
|---|---|---|---|---|
| 3,256,138 | A | 6/1966 | Welch et al. | |
| 3,880,706 | A * | 4/1975 | Williams | 162/103 |
| 5,716,695 | A * | 2/1998 | Benoit et al. | 428/195.1 |
| 2006/0198987 | A1 * | 9/2006 | Grob et al. | 428/137 |

FOREIGN PATENT DOCUMENTS

| | | | |
|---|---|---|---|
| EP | 0 628 408 | A | 12/1994 |
| WO | WO 99/66127 | A | 12/1999 |

OTHER PUBLICATIONS

International Search Report of PCT/FR2004/003403, date of mailing Jul. 25, 2005.

* cited by examiner

*Primary Examiner*—Mark Ruthkosky
*Assistant Examiner*—David J Joy
(74) *Attorney, Agent, or Firm*—Westerman, Hattori, Daniels & Adrian, LLP

(57) ABSTRACT

The invention concerns a security paper comprising at least two plies of paper, wherein at least one intermediate layer arranged between the two plies of paper comprises at least one element providing the paper with high double folding resistance, such as defined by the NF ISO 5626 standard, the two plies and said intermediate layer being closely assembled. The invention also concerns a method for making said paper whereby the intermediate layer is deposited by spraying.

23 Claims, No Drawings

SECURITY PAPER HIGHLY RESISTANT TO DOUBLE FOLDING AND METHOD FOR MAKING SAME

The present invention relates to a security paper and, more particularly, to a security paper used for the manufacture of banknotes, passports, certificates of authenticity and checks.

The invention also relates to a process for manufacturing said security paper.

Very many printed documents require increasing means for ensuring their authentication and their security protection.

These documents range from banknotes to travel documents, and also include scratchcards, playing cards, checks, identity cards and passports.

To allow the user or holder of the security document to check the authenticity of the document in a simple and reliable manner, it is common practice to include authentication elements within the thickness of the constituent material of the document.

Including such authentication elements is also intended to prevent ill-intentioned people from counterfeiting the document by reproducing, identically or almost identically, the features of said document.

In this regard, it is common to provide areas of smaller thickness within the fibrous layer, thus forming a watermark in the final security document, said watermark preventing, in particular, the reproduction of said document by photocopying.

In parallel with these problems associated with authenticating security documents and preventing them from being counterfeited, it is also essential to ensure that these security documents, subjected to repeated stresses over the course of their use, have a sufficiently long lifetime.

In particular, in the case of a banknote especially, for example it is necessary to take into account the fact that the banknote is frequently handled, in particular repeatedly folded and unfolded, which, if no modification of the fiber structure has been envisioned in this regard, may result in rapid deterioration, or even tearing, of said banknote.

Patent application EP-A-628 408 describes a reinforced security paper consisting of two sheets of paper between which a plastic sheet is laminated. This sheet has the advantage, apart from that of including an authentication element, of improving the fold resistance of the security paper. However, this manufacturing process requires several bonding steps in order to join the various sheets together, these steps being carried out external to the paper machine line once the sheets of paper have been manufactured (and therefore dried). The paper could therefore, on the one hand, delaminate fairly easily, and on the other hand, could be quite easily manufactured by counterfeiters, who can laminate sheets of paper to a sheet of plastic.

It may also be advantageous to introduce certain reinforcing materials into the fibrous layer.

However, problems in forming the sheet may appear when too high a content of reinforcing materials is added.

The Applicant has, in particular, found that introducing synthetic fibers into a fibrous layer, for the purpose of increasing its mechanical strength, in fact degrades the quality and the rendition of a watermark formed within this layer.

One of the objects of the invention is therefore to propose a novel security paper and a method of obtaining security documents that reconcile both correct and reliable security protection of said document while giving it mechanical strength or chemical resistance suitable for its customary use.

In this regard, adding reinforcing elements using a coating technique may be envisaged.

In most applications requiring a medium possessing better mechanical or physical properties, it is known to apply a layer to a cellulose-type basis medium.

Such layers are conventionally applied on both sides of a dry sheet of paper using a size press, which is made up of a pair of rollers forming a pinch zone through which the sheet passes.

However, this method of depositing a layer has a number of disadvantages which reduce the effectiveness of the paper machine as a whole.

This is because size presses have a large number of moving parts, which require frequent adjustment and entail not insignificant amounts of time for maintaining and cleaning them.

In some applications, ancillary coating devices have also been provided that are positioned downstream of the paper machine itself.

These devices have the major drawback of greatly increasing the space occupied by the paper machine and of requiring further energy consumption to dry the paper thus rewetted.

Another object of the invention is therefore to propose a novel process for depositing a layer on a fibrous web, which process is simple, inexpensive and can be easily added on to existing paper machines.

In this regard, the Applicant had the idea of using liquid spraying devices for depositing a layer containing reinforcing elements on to the surface of a paper in the process of being formed.

These liquid spraying devices have few moving parts and require less maintenance.

In addition, they can be fitted easily on to existing paper machines.

Moreover, aware that depositing a layer on only one side of the paper leads to dissymmetry in the physical and mechanical properties of the paper between the coated and the uncoated side, the Applicant also had the idea of throwing the layer between two assembled plies of paper, which are then pressed together and dried in a conventional manner.

This technique also has the advantage of not modifying the surface properties of the base paper, which may be particularly useful in the case of papers intended for being printed.

One object of the present invention is therefore to provide a security paper comprising at least two plies of paper, in which, at least in one area, at least one interlayer placed between the two plies of paper includes at least one element giving the paper a high double-fold resistance, as defined in the standard NF ISO 5626, said element being in "diffuse" form and/or in the form of particles, and the two plies and said interlayer being intimately joined together.

The term "diffuse" is understood to mean that the element is dissolved or emulsified in the composition of the layer and is distributed diffusely between said plies. The expression "element in the form of particles" is understood to mean an element in the form of pigments, fibers or agglomerates, and more generally in a variety of small-sized forms. The pigments may range from the order of some hundred microns down to a nanometer; the fibers may be round or flat fibers, a few microns or millimeters, or even centimeters in length and a few microns or nanometers in diameter or width. The expression "the two plies and said interlayer being intimately joined together" is understood to mean that constituents of each of the plies and also those of the composition of the layer (including said element) are partially interpenetrating. It would be impossible, once the paper has dried, to cleanly separate the plies at the place where they are joined. Examination in cross section using a microscope, especially an electron microscope, reveals the intimate assembly of these two plies and said element, whereas, if the layer had been placed between the two paper sheets once they had been dried, a less intimate assembly would be observed both between the plies and also with the constituents of the layer. Such an assembly may be obtained as described later by assembling the two plies and the composition directly, that is to say that the composition is thrown between the plies, especially on at least one of the two still-wet plies and are immediately joined together (while they are wet).

More particularly, said interlayer is placed by throwing, in particular by spraying a composition containing said element.

Preferably, the surface between the two plies is entirely covered by said layer.

According to a preferred embodiment of the invention, the double-fold resistance of the paper is greater than a value $DF_{min}$, where $DF_{min}$=75 000 E, where E is the percentage dry weight of the element in the paper.

According to one particular embodiment of the invention, said element is chosen from mineral pigments, especially clays or titanium dioxide, organic pigments, natural or synthetic binders, especially starches or polyvinyl alcohols, polyurethanes or styrene/butadiene copolymers, or natural or synthetic fibers, especially polyester or polyamide fibers, and mixtures thereof. As organic pigments, plastic coating pigments, for example solid or hollow polystyrene microspheres, may be used. As natural fibers, textile fibers, such as abaca, hemp, flax or chinook fibers and mixtures thereof, may, for example, be used. More particularly, when the element is a binder, such as polyurethane or styrene/butadiene copolymer binders, it may be used in latex form, that is to say in the form of an emulsion of a polymer in aqueous medium.

Preferably, the weight of each ply is between 30 and 60 $g/m^2$.

According to another particular embodiment of the invention, at least one of the plies of paper includes a watermark.

According to another particular embodiment of the invention, the interlayer also includes at least one authentication element.

According to another particular embodiment of the invention, the authentication element can be detected optically.

According to another particular embodiment of the invention, the authentication element is chosen from iridescent particles, fluorescent particles, phosphorescent particles, colored particles, and flakes. In particular, these particles may be fibers.

According to another particular embodiment of the invention, the authentication element reacts to certain stimulations giving a specific signal that can be detected using a suitable device.

According to another particular embodiment of the invention, the authentication element is chosen from substances that react to electromagnetic fields, in particular of the microwave or infrared or ultraviolet type.

The elements providing the double-fold resistance may also act as authentication elements.

Another object of the invention is to protect a process for manufacturing a security paper having a high double-fold resistance as defined in the standard NF ISO 5626, as described above, which comprises the following steps:

a first pulp composition is deposited on a first dewatering wire;

the first pulp composition is drained so as to form a first fibrous mat;

a second pulp composition is deposited on a second dewatering wire;

the second pulp composition is drained so as to form a second fibrous mat;

a liquid mixture, containing at least one soluble element, or an element in emulsion or in the form of particles, giving said high double-fold resistance, is thrown onto at least one of said fibrous mats; and said first fibrous mat is joined to said second fibrous mat in order to form a unitary fibrous mat.

The term "liquid composition" is understood to mean a composition produced in liquid medium. Such a liquid composition may be a suspension, an emulsion or a solution. Preferably the liquid medium is aqueous.

Preferably, said composition is thrown by spraying.

According to one particular method of implementing the invention, at least one watermark is formed in the first and/or in the second fibrous mat.

According to another particular method of implementing the invention, a liquid composition containing at least one authentication element is thrown onto said first and/or said second fibrous mat.

According to another particular method of implementing the invention, the first pulp composition or the second pulp composition is drained by means of a Fourdrinier wire, a double wire or a cylinder mold.

According to another particular method of implementing the invention, additional steps of pressing and drying the unitary fibrous mat are provided.

The invention will be more clearly understood from the examples presented below.

COMPARATIVE EXAMPLE 1

A series of paper sheets of square format and of 310 $cm^2$ in area was produced from a fibrous composition containing, by dry weight, 100 parts of pure cotton cellulose fibers, using a laboratory handsheet mold. The weight of the paper obtained was 85 $g/m^2$. The laboratory handsheet mold was also suitable for applying a watermark pattern within the thickness of the paper obtained.

COMPARATIVE EXAMPLE 2

A series of paper sheets of square format and of 310 $cm^2$ in area was produced from a fibrous composition containing, by dry weight, 100 parts of pure cotton cellulose fibers and 12 parts of synthetic polyethylene terephthalate fibers, using a laboratory handsheet mold. The weight of the paper obtained was 85 $g/m^2$. The laboratory handsheet mold was also suitable for applying a watermark pattern within the thickness of the paper obtained.

EXAMPLE 3

A first series of paper sheets of square format and of 310 $cm^2$ in area was produced from a fibrous composition containing, by dry weight, 100 parts of pure cotton cellulose fibers using a laboratory handsheet mold. The weight of the paper obtained in this first series was 40 $g/m^2$. The laboratory handsheet mold in this series was also suitable for applying a watermark pattern within the thickness of the paper. Next, a second series of paper sheets of square format and of 310 $g/m^2$ in area was produced from a fibrous composition containing, by dry weight, 100 parts of pure cotton cellulose fibers using a laboratory handsheet mold. The weight of the paper of this second series was 40 $g/m^2$.

About 8 $g/m^2$ by dry weight of a coating composition, comprising a carboxylated styrene/butadiene copolymer latex (in aqueous emulsion), were deposited, using a small manual spray device, on one side of a paper of the second series. Next, a sheet of the first series was joined, in the wet state, to a sheet of the second series, the coated side of the sheet of the second series being covered by the sheet of the first series. The complex obtained was dried. In this complex, the percentage dry weight of latex was then about 0.09.

COMPARATIVE EXAMPLE 4

Two plies of paper were produced from a fibrous composition containing, by dry weight, 100 parts of pure cotton cellulose fibers using a paper machine of the cylinder mold/former type. The ply from the cylinder mold and the ply from the former were joined together in the wet state. About 2.5 g/m$^2$ by dry weight of a coating composition, comprising a carboxylated polyvinyl alcohol, were deposited by means of a size press. The complex obtained was dried. The weight of the complex obtained was then 83.1 g/m$^2$.

EXAMPLE 5

Two plies of paper were produced from a fibrous composition containing, by dry weight, 100 parts of pure cotton cellulose fibers using a paper machine of the cylinder mold/former type. About 2.5 g/m$^2$ by dry weight of a coating composition, comprising a carboxylated polyvinyl alcohol, were sprayed on to one side of the ply of paper coming from the former, using a rail consisting of three spray nozzles 10 cm apart and positioned about 9 cm from the sheet. The ply from the cylinder mold and the ply from the former were joined together in the wet state, the coated side of the ply coming from the former being covered by the ply from the cylinder mold. The complex obtained was dried. The weight of the complex obtained was then 82.7 g/m$^2$. In this complex, the percentage dry weight of carboxylated polyvinyl alcohol was then about 0.03 percent.

Tests Carried Out on Examples 1 to 3

The mechanical strength of the paper in each of examples 1 to 3 was firstly evaluated using standardized tests. The tear index of the papers obtained was thus evaluated by applying the NF EN 21974 standard. The double-fold resistance was also evaluated by applying the NF ISO 5626 standard. The rendition of the watermark in each of examples 1 to 3 was then visually assessed.

Test Carried Out on Examples 4 and 5

The mechanical strength of the paper in each of examples 4 and 5 was firstly evaluated using standardized tests. The double-fold resistance was thus evaluated by applying the NF ISO 5626 standard. The surface finish of the papers obtained in examples 4 and 5 was also compared. The whiteness of the papers was thus evaluated by applying the NF ISO 2470 standard.

Results of the Tests:

Table 1 below gives the results of the tests carried out on examples 1 to 3. This shows that the mechanical strength of the paper increases when a latex is sprayed between the plies of paper and when synthetic fibers are introduced into the fibrous composition. However, it may be seen that the rendition of the watermark remains correct in example 3 corresponding to the invention, whereas in comparative example 2 this watermark has practically disappeared. Table 2 gives the results of tests carried out on examples 4 and 5. This shows that the whiteness of the paper in comparative example 4 is slightly inferior to that of example 5 according to the invention. This confirms that deposition of a surface layer has a tendency to affect the surface characteristics of the paper, whereas deposition by spraying between two plies of paper, as the invention envisions, has no effect on these same characteristics. Moreover, a minimum double-fold resistance $DF_{min}$ for each of the examples was defined, this value corresponding to a limit below which the paper must be considered as not being resistant enough, given the requirements of users. This value was expressed, for the sake of simplification, as a single formula for being able to adapt it to the various types of paper involved, in particular depending on the weight of the layer deposited. This is because the greater the amount of layer in the paper, the higher the required minimum double-fold resistance. By extrapolation, we have defined a minimum double-fold resistance value $DF_{min}$ by the formula:

$DF_{min}$=75 000 X (percentage dry weight of the mechanical reinforcement elements present in the layer relative to the paper).

This value was calculated, in table 1, using the percentage dry weight of latex in the paper of example 3 and in table 2, using the percentage dry weight of carboxylated polyvinyl alcohol in the paper of example 5. It may be seen in comparative examples 1, 2 and 4 that the double-fold resistance values are all inferior to the required $DF_{min}$ value. In contrast, in the examples according to the invention, these values are quite considerably above the required $DF_{min}$ value.

TABLE 1

| | COMPARATIVE EXAMPLE 1 | COMPARATIVE EXAMPLE 2 | EXAMPLE 3 |
|---|---|---|---|
| Tear index (in Mn · m$^2$/g) | 6.9 | 9.7 | 7.35 |
| Double fold | 2769 | 6722 | 7026 |
| Watermark rendition | Good | Mediocre | Good |
| $DF_{min}$ | 6750 | 6750 | 6750 |

TABLE 2

| | COMPARATIVE EXAMPLE 4 | EXAMPLE 5 |
|---|---|---|
| Double fold | 2014 | 2623 |
| ISO Whiteness | 73.9% | 75.2% |
| $DF_{min}$ | 2250 | 2250 |

The invention claimed is:

1. A security paper comprising:

at least two plies of cellulose-type paper each formed of a respective fibrous mat, and at least in one area, at least one interlayer located at the junction of the two plies of cellulose-type paper, wherein the security paper includes an authentication element within a thickness of the security paper, and wherein the interlayer includes at least one element giving the security paper a high double-fold resistance, as defined by the standard NF ISO 5626, said element being at least one of (i) a soluble element or an emulsifiable element, and (ii) an element in the form of particles, and wherein the two plies and said element are intimately joined together in the interlayer, wherein (i) constituents of each of the two plies are interpenetrating with each other in the interlayer, and (ii) constituents of each of the two plies and constituents of the interlayer including said element are interpenetrating with one another in the interlayer, so that the fibrous mats of the two plies of cellulose-type paper form a unitary fibrous mat throughout the area of the interlayer.

2. The security paper as claimed in claim 1, wherein said interlayer is formed by throwing a composition containing said element.

3. The security paper as claimed in claim 1, wherein the interlayer covers the entire surface area of the two plies.

4. The security paper as claimed in claim 1, wherein the weight of each ply is between 30 and 60 g/m$^2$.

5. The security paper as claimed in claim 1, wherein the double-fold resistance of the paper is greater than a value $DF_{min}$, where:

$$DF_{min}=75\ 000\ E,$$

where E is the percentage dry weight of the element in the paper.

6. The security paper as claimed in claim 1, wherein said element is chosen from mineral pigments, especially clays or titanium dioxide, organic pigments, natural or synthetic binders, especially starches or polyvinyl alcohols, polyurethanes or styrene/butadiene copolymers, or natural or synthetic fibers, especially polyester or polyamide fibers, and mixtures thereof.

7. The security paper as claimed in claim 1, wherein at least one of the plies of paper includes a watermark.

8. The security paper as claimed in claim 1, wherein the interlayer also includes at least one authentication element.

9. The security paper as claimed in claim 8, wherein the authentication element can be detected optically.

10. The security paper as claimed in claim 9, wherein the authentication element is chosen from iridescent particles, fluorescent particles, phosphorescent particles, colored particles, and flakes.

11. The security paper as claimed in claim 8, wherein the authentication element is chosen from substances that react to electromagnetic fields.

12. The security paper as claimed in claim 11, wherein the authentication element is chosen from substances that react to microwave or infrared or ultraviolet fields.

13. The security paper as claimed in claim 8, wherein the element providing the double-fold resistance is also an authentication element.

14. The security paper as claimed in claim 1, wherein the element is a binder in latex form.

15. The security paper as claimed in claim 1, wherein the element is a latex of a polyurethane or styrene/butadiene copolymer binder.

16. A process for manufacturing a security paper having a high double-fold resistance as defined in the standard NF ISO 5626, as claimed in claim 1, which comprises the following steps:

a first pulp composition is deposited on a first dewatering wire;

the first pulp composition is drained so as to form a first fibrous mat;

a second pulp composition is deposited on a second dewatering wire;

the second pulp composition is drained so as to form a second fibrous mat;

a liquid composition, containing a soluble element, or an element in emulsion or in the form of particles, giving said high double-fold resistance, is thrown onto at least one of said fibrous mats; and said first fibrous mat is joined to said second fibrous mat in order to form a unitary fibrous mat throughout the area of the interlayer, wherein (i) constituents of each of the two plies are interpenetrating with each other in the interlayer, and (ii) constituents of each of the two plies and constituents of the interlayer including said element are interpenetrating with one another in the interlayer, the element is distributed in the interlayer, and a portion of each of the two plies and said element are intimately joined together in the interlayer, wherein constituents of each of the two plies and constituents of the interlayer including said element are interpenetrating in the interlayer.

17. The process as claimed in claim 16, wherein said composition is thrown by spraying.

18. The process as claimed in claim 16, wherein at least one watermark is formed in the first and/or the second fibrous mat.

19. The process as claimed in claim 16, wherein a liquid composition containing at least one authentication element is thrown onto said first and/or said second fibrous mat.

20. The process as claimed in claim 16, wherein the first pulp composition or the second pulp composition is drained by means of a Fourdrinier wire, a double wire or a cylinder mold.

21. The process as claimed in claim 16, wherein it includes additional steps of pressing and drying the unitary fibrous mat.

22. The process as claimed in claim 16, wherein the liquid solution is a binder in latex form.

23. The process as claimed in claim 16, wherein the liquid solution is a latex of a polyurethane or styrene/butadiene binder.

* * * * *

UNITED STATES PATENT AND TRADEMARK OFFICE

CERTIFICATE OF CORRECTION

PATENT NO. : 7,754,314 B2
APPLICATION NO. : 10/584763
DATED : July 13, 2010
INVENTOR(S) : Henri Rosset et al.

It is certified that error appears in the above-identified patent and that said Letters Patent is hereby corrected as shown below:

In item 73:
Change

"Issy Les Moulineaux"

To be

--Paris--

Signed and Sealed this

Fourteenth Day of December, 2010

David J. Kappos

David J. Kappos
*Director of the United States Patent and Trademark Office*